US009807833B2

(12) United States Patent
Lee et al.

(10) Patent No.: US 9,807,833 B2
(45) Date of Patent: Oct. 31, 2017

(54) POWER APPARATUS FOR LED LIGHTING

(71) Applicant: LG INNOTEK CO., LTD., Seoul (KR)

(72) Inventors: Dong Soo Lee, Seoul (KR); Joo Hoon Kim, Seoul (KR); Seok Yoon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/038,884

(22) PCT Filed: Nov. 26, 2014

(86) PCT No.: PCT/KR2014/011426
§ 371 (c)(1),
(2) Date: May 24, 2016

(87) PCT Pub. No.: WO2015/080467
PCT Pub. Date: Jun. 4, 2015

(65) Prior Publication Data

US 2017/0006678 A1 Jan. 5, 2017

(30) Foreign Application Priority Data

Nov. 26, 2013 (KR) ..... 10-2013-0144389
Nov. 26, 2013 (KR) ..... 10-2013-0144392
Nov. 26, 2013 (KR) ..... 10-2013-0144393

(51) Int. Cl.
*H05B 33/08* (2006.01)

(52) U.S. Cl.
CPC ..... *H05B 33/0845* (2013.01); *H05B 33/0815* (2013.01); *H05B 33/0887* (2013.01)

(58) Field of Classification Search
CPC ..... H05B 33/0815; H05B 33/0818; H05B 33/0884
(Continued)

(56) References Cited

U.S. PATENT DOCUMENTS 6,864,644 B2 * 3/2005 Kernahan ..... H05B 41/3927 315/209 PZ
2010/0156319 A1 * 6/2010 Melanson ..... H05B 33/0839 315/297
(Continued)

FOREIGN PATENT DOCUMENTS

KR 10-2011-0053121 A 5/2011
KR 10-2012-0038386 A 4/2012
(Continued)

OTHER PUBLICATIONS

KR 10-2012-0135825 A, machine translation.*
(Continued)

*Primary Examiner* — Douglas W Owens
*Assistant Examiner* — Syed M Kaiser
(74) *Attorney, Agent, or Firm* — Ked & Associates, LLP

(57) ABSTRACT

The present invention relates to a power apparatus for an LED lighting, and more specifically, to an LED lighting comprising: a filter for blocking noise from an inputted AC power; a rectifier, which is connected to the filter, for converting AC power into DC power; a power factor compensation circuit for controlling the power factor of power received from the rectifier; a central control circuit for controlling the operation of the power apparatus for the LED lighting; and an LED control circuit for controlling power inputted through the power factor compensation circuit and providing same to an LED, wherein the power factor compensation circuit includes a bypass element connected between an input end and an output end.

23 Claims, 10 Drawing Sheets

(58) Field of Classification Search
USPC ..... 315/224, 297, 76, 121, 201, 22
See application file for complete search history.

(56) References Cited

U.S. PATENT DOCUMENTS

| | | | | |
|---|---|---|---|---|
| 2010/0176733 | A1* | 7/2010 | King | H05B 37/0245 315/158 |
| 2010/0309188 | A1 | 12/2010 | Hying et al. | |
| 2012/0019714 | A1* | 1/2012 | Hiramatu | H05B 33/0815 348/370 |
| 2012/0043900 | A1* | 2/2012 | Chitta | H05B 41/295 315/201 |
| 2012/0286681 | A1* | 11/2012 | Hausman, Jr. | H05B 41/2828 315/200 R |
| 2014/0139109 | A1* | 5/2014 | Morales | H05B 33/0845 315/121 |
| 2014/0159608 | A1* | 6/2014 | Simi | H05B 33/0815 315/205 |
| 2014/0354170 | A1* | 12/2014 | Gredler | H05B 33/0815 315/224 |
| 2015/0312982 | A1* | 10/2015 | Melanson | H05B 33/0815 315/287 |

FOREIGN PATENT DOCUMENTS

| | | | |
|---|---|---|---|
| KR | 10-2012-0135825 | A | 12/2012 |
| KR | 10-2013-0106799 | A | 9/2013 |
| KR | 10-2013-0119919 | A | 11/2013 |

OTHER PUBLICATIONS

KR 10-2012-0038386 A, machine translation.*
International Search Report dated Feb. 16, 2015 issued in Application No. PCT/KR2014/011426.

* cited by examiner

FIG. 10
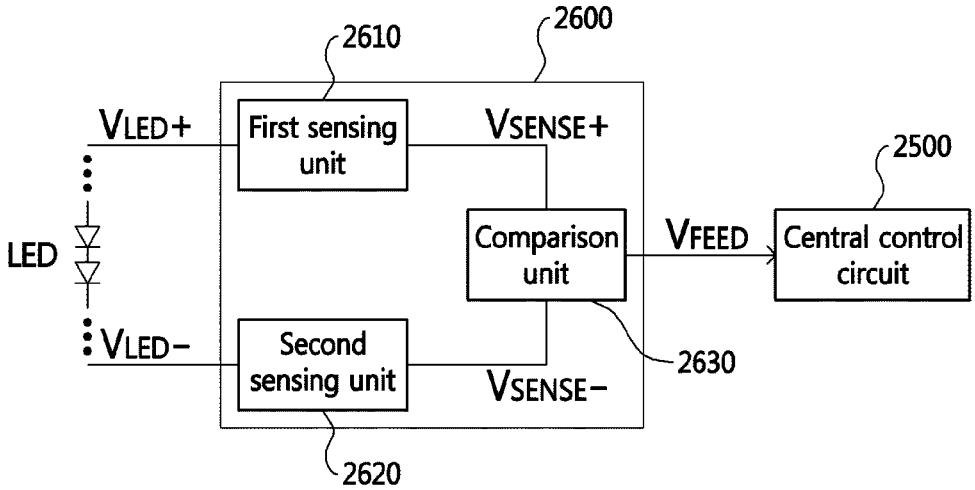
FIG.11
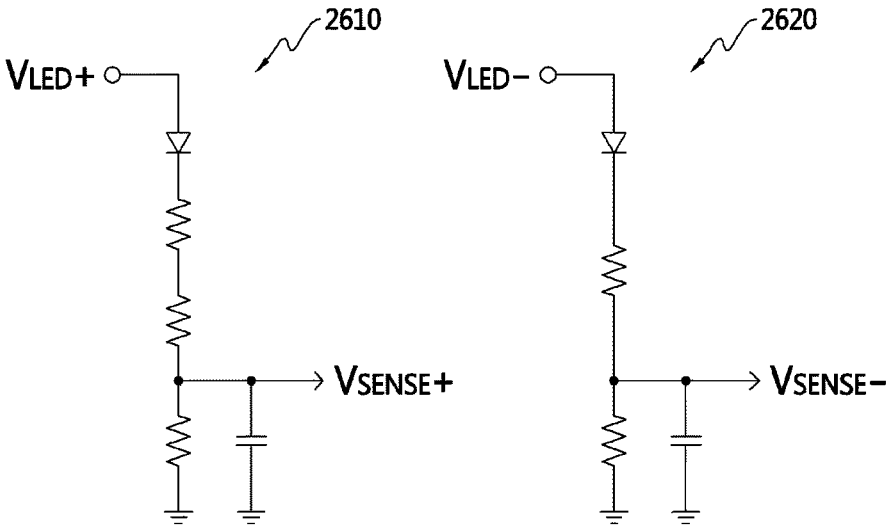
FIG.12

(a)

(b)

POWER APPARATUS FOR LED LIGHTING

CROSS-REFERENCE TO RELATED PATENT APPLICATIONS

This application is a U.S. National Stage Application under 35 U.S.C. §371 of PCT Application No. PCT/KR2014/011426, filed Nov. 26, 2014, which claims priority to Korean Patent Application Nos. 10-2013-0144389, filed Nov. 26, 2013, 10-2013-0144392, filed Nov. 26, 2013, and 10-2013-0144393, filed Nov. 26, 2013, entire disclosures are hereby incorporated by reference.

BACKGROUND OF THE INVENTION

1. Technical Field

The present invention relates to a power apparatus for an LED light and, more particularly, to an apparatus for controlling power of a device which provides lighting complying with a user's need by controlling an outdoor LED light device.

2. Description of the Related Art

A light-emitting diode (LED) is a kind of semiconductor device for converting electric energy into light. An LED has advantages of low power consumption, a semipermanent life span, fast response speed, stability, and an eco-friendly property compared to existing light sources, such as a fluorescent light and an incandescent light. In particular, an LED light device can perform various productions by controlling the blinking sequence, light-emitting color and brightness, etc. of a plurality of arranged and installed LEDs.

Lots of researches for replacing existing conventional light sources with LEDs are in progress. LEDs are increasingly used as the light sources of light devices, such as a variety of types of lamps, liquid crystal displays, electric bulletin boards, and streetlights which are used indoors and outdoors. In particular, LEDs are used for common lights for indoor interior, stage lights for producing a specific atmosphere, advertising lights, and scene lights.

A light device may be installed in the outer wall of a building, a park, a streetlight, a bridge rail or a theater as a scene light. The size and application system of a light device may be different depending on an applied use, object or location. That is, a light device for the outer wall of a building is used to have a simple blinking function or to simply display a single color or combined color in a belt form in the outer wall of a building. A light device for a park, streetlight or bridge rail is irregularly installed depending on the shape of an object so that blinking or color is changed. Furthermore, a light device for a theater may be chiefly used to have a magnificent effect in a theater by displaying simple blinking or color in a belt form around the stage or in the stage.

An outdoor light device needs to be stably driven because it has difficulties in maintenance and management compared to an indoor light device. Accordingly, there is a strong need for various schemes for stably controlling an outdoor light device.

SUMMARY OF THE INVENTION

An object of the present invention is to improve surge immunity by improving the structure of an internal circuit which controls a power apparatus for an LED light.

Meanwhile, an object of the present invention is to propose the internal circuit of a power apparatus for an LED light for reducing electromagnetic interference (EMI).

An object of the present invention is to propose a scheme for controlling a digital circuit using an analog circuit by implementing a portion that belongs to functions necessary for control of a power apparatus for an LED light and that is unable to be implemented in a circuit form using an IC circuit.

An object of the present invention is to propose a structure for accurately measuring the voltage of an LED and effectively controlling power in driving a power apparatus for an LED light.

In particular, an object of the present invention is to accurately analyze a measured LED voltage and to stably drive a power apparatus for an LED light within a driving power range.

A power apparatus for an LED light according to the present invention for accomplishing the above objects includes a filter which blocks noise of input AC power, a rectifier which is connected to the filter and converts the AC power into DC power, a power factor correction circuit which controls the power factor of power received from the rectifier, a central control circuit which controls the operation of the power apparatus for an LED light, and an LED control circuit which adjusts power received via the power factor correction circuit and provides the adjusted power to an LED. In this case, the power factor correction circuit may include a bypass element connected between an input stage and an output stage. The bypass element may be implemented using a rectifier element.

Meanwhile, a bead may be connected to the gate of a switching element included in the power factor correction circuit of the present invention. A bead may be connected to the drain of the switching element included in the power factor correction circuit. In this case, the bead may be implemented using an inductance element.

In accordance with another embodiment of the present invention, a bead may be connected between the drain and source of the switching element included in the power factor correction circuit. The bead may be implemented using a capacitance element.

A power apparatus for an LED light according to the present invention includes a filter which blocks noise of input AC power, a rectifier which is connected to the filter and converts the AC power into DC power, a power factor correction circuit which controls the power factor of power received from the rectifier, a central control circuit which controls the operation of the power apparatus for an LED light, an LED control circuit which adjusts power received via the power factor correction circuit and provides the adjusted power to an LED, and a current conversion circuit which senses an electric current of the LED and transmits the sensed current to the LED control circuit. The current conversion circuit may include a signal input unit which receives a pulse width modulation signal from the central control circuit, a switching element which operates in response to the pulse width modulation signal received from the signal input unit, and a current control unit which is connected to the switching element, processes an electric current received from the LED in response to the operation of the switching element, and transmits the processed current to the LED control circuit.

In this case, the duty ratio of the pulse width modulation signal received through the signal input unit may be adjusted by the central control circuit. The switching element may control ON/OFF in response to the pulse width modulation signal having the adjusted duty ratio. The current control unit may control an electric current inputted to the LED control circuit in response to the ON/OFF of the switching element.

The switching element may be implemented using an FET element. In this case, the signal input unit may be connected to the gate terminal of the FET element.

Meanwhile, in another embodiment of the present invention, a resistor may be further included between the signal input unit and a ground terminal. The current control unit may have a plurality of resistors connected to a node connected to the drain terminal of the FET element. A capacitance element may be included between the drain terminal of the FET element and a ground terminal.

In accordance with an embodiment of the present invention, a level of a voltage output by the current control unit may be adjusted in response to control of the duty ratio. If the duty ratio is 0, a minimum current of the current control unit may flow into the LED control circuit. If the duty ratio is 1, a maximum current of the current control unit may flow into the LED control circuit.

A power apparatus for an LED light according to the present invention includes a filter which blocks noise of input AC power, a rectifier which is connected to the filter and converts the AC power into DC power, a power factor correction circuit which controls the power factor of power received from the rectifier, a central control circuit which controls the operation of the power apparatus for an LED light, an LED control circuit which adjusts power received via the power factor correction circuit and provides the adjusted power to an LED, and a voltage measurement circuit which senses a voltage of the LED and transmits the sensed voltage to the central control circuit. The voltage measurement circuit may include a first sensing unit which senses a voltage at the positive pole of the LED, a second sensing unit which senses a voltage at the negative pole of the LED, and a comparison unit which compares a result of the voltage sensing of the first sensing unit with a result of the voltage sensing of the second sensing unit.

In this case, the first sensing unit or the second sensing unit may include a rectifying unit for filtering a positive voltage and may further include a voltage adjustment unit for adjusting an amount of the sensed voltage. Meanwhile, the voltage adjustment unit may be implemented by connecting a plurality of resistors in series.

In another embodiment of the present invention, the first sensing unit or the second sensing unit may include a smoothing unit for smoothing the sensed voltage. The smoothing unit may be implemented by a capacitance element.

Meanwhile, in another embodiment of the present invention, the comparison unit may be implemented by a differential amplification circuit.

BRIEF DESCRIPTION OF THE DRAWINGS

FIG. 10 is a block diagram showing a voltage measurement circuit within the power apparatus for an LED light according to the present invention.

FIG. 11 is a circuit diagram showing the first sensing unit and second sensing unit of a voltage measurement circuit within the power apparatus for an LED light according to the present invention.

DETAILED DESCRIPTION

The details of the aforementioned objects and technical configurations of the present invention and acting effects thereof will be more clearly understood from the following detailed description based on the accompanying drawings.

Hereinafter, the present invention is described in detail with reference to the accompanying drawings.

Figure 1:
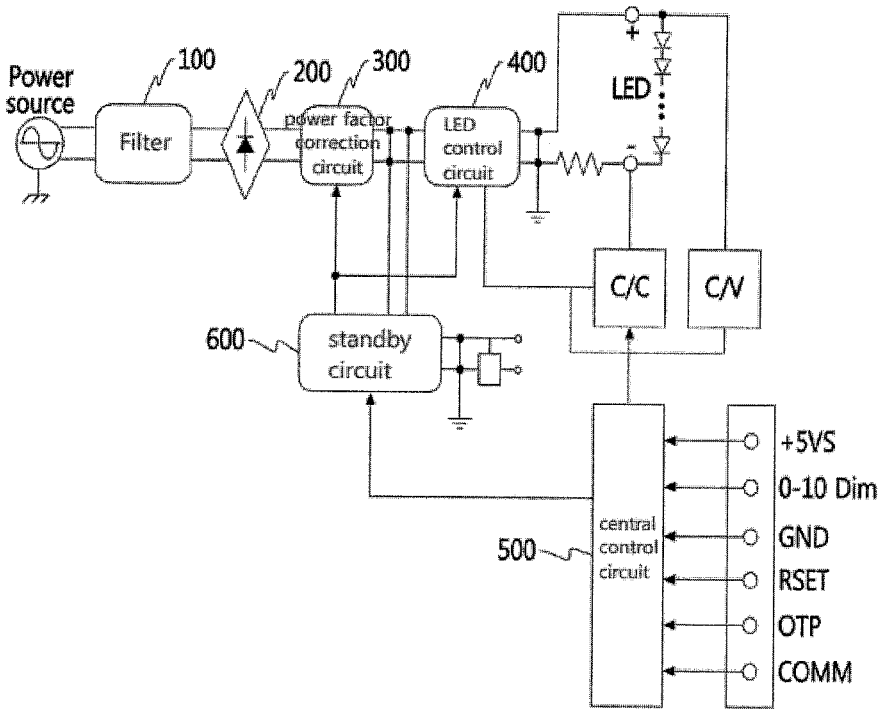
FIG. 1 is a block diagram showing the structure of a power apparatus for an LED light according to an embodiment of the present invention.

FIG. 1 is a block diagram showing the structure of a power apparatus for an LED light according to an embodiment of the present invention.

The power apparatus for an LED light according to the present invention includes a filter 100 which blocks noise of input AC power, a rectifier 200 which is connected to the filter 100 and converts AC power into DC power, a power factor correction circuit 300 which controls the power factor of power received from the rectifier 200, a central control circuit 500 which controls the operation of the power apparatus for an LED light, and an LED control circuit 400 which adjusts power received via the power factor correction circuit 300 and provides the adjusted power to an LED.

The filter 100 of the present invention is an element for blocking noise included in power (commercialized power is AC power) received from the outside. The power apparatus for an LED light according to the present invention controls various operations, such as the ON/OFF of the LED, using commercialized AC power. The LED is driven by DC power. That is, there is a need for a process for converting the AC power into the DC power. Prior to the power conversion, noise of various components included in the AC power is removed so that power is efficiently converted. Furthermore, damage to parts of the power apparatus attributable to a noise signal is prevented by preventing a variety of types of noise, transferred by a system, from entering a power apparatus for an LED light.

The rectifier 200 of the present invention is a device for converting AC power into DC power. As described above, an LED light is driven by DC power, but commercialized power is AC power. Accordingly, commercialized power needs to be converted into DC power. To this end, the present invention includes the rectifier 200. The rectifier 200 of the present invention may be implemented in various forms of rectifier elements, such as a half-bridge rectifier and a full-bridge rectifier.

The power factor correction circuit 300 of the present invention is an element for improving efficiency of input versus output by improving the power factor of the entire circuit. Furthermore, the power factor correction circuit 300 is an element for delivering an insulated voltage to the LED control circuit 400.

The power factor correction circuit 300 of the present invention may be implemented using a boost circuit, but is not limited thereto. A device having the same function should be considered to be included in the power factor correction circuit 300 written in the claims of the present invention.

A standby circuit 600 of the present invention is an element for supplying auxiliary power for driving the power apparatus for an LED light according to the present invention. In particular, if the central control circuit 500 of the present invention waits in the on state in the state in which the LED has not been driven and power and a control command for driving the LED are inputted, the standby circuit 600 controls the LED in response to the power and control command. In this case, in the state in which only AC power has been inputted to the power apparatus for an LED light prior to the driving of the LED, in order to maintain the central control circuit 500 in the standby state using the AC power, the present invention includes the standby circuit 600. An example for implementing the standby circuit 600 may include a flyback circuit.

The central control circuit 500 of the present invention is an element for controlling an overall operation of the power apparatus for an LED light. The central control circuit 500 executes various functions, such as whether the LED is to be driven, the brightness of the LED, and communication with the outside in response to a user's input. In particular, the central control circuit 500 functions to generally manage the operation of the power apparatus by receiving information about the operating state of each element within the power apparatus and controlling each element. The central control circuit 500 may be implemented through a control device, such as a microcomputer.

The LED control circuit 400 is an element for controlling power provided to the LED via the power factor correction circuit 300 in response to a signal received from the central control circuit 500. The amount of LED power inputted via the power factor correction circuit 300 may be greater or smaller than driving power of the LED (generally, greater). The LED control circuit 400 converts the LED power into a degree suitable for driving the LED by adjusting the scale of the LED power, for example, by a DC-DC conversion and supplies the converted power to the LED. Furthermore, the LED control circuit 400 controls whether the LED is to be driven, the brightness of the LED, and the driving time of the LED in response to a signal received from the central control circuit 500.

However, elements described above may not be included in the power apparatus for an LED light depending on a design change, and a new element not described above may be further included in the power apparatus for an LED light.

A structure proposed by the present invention is described in more detail below.

Figure 2:
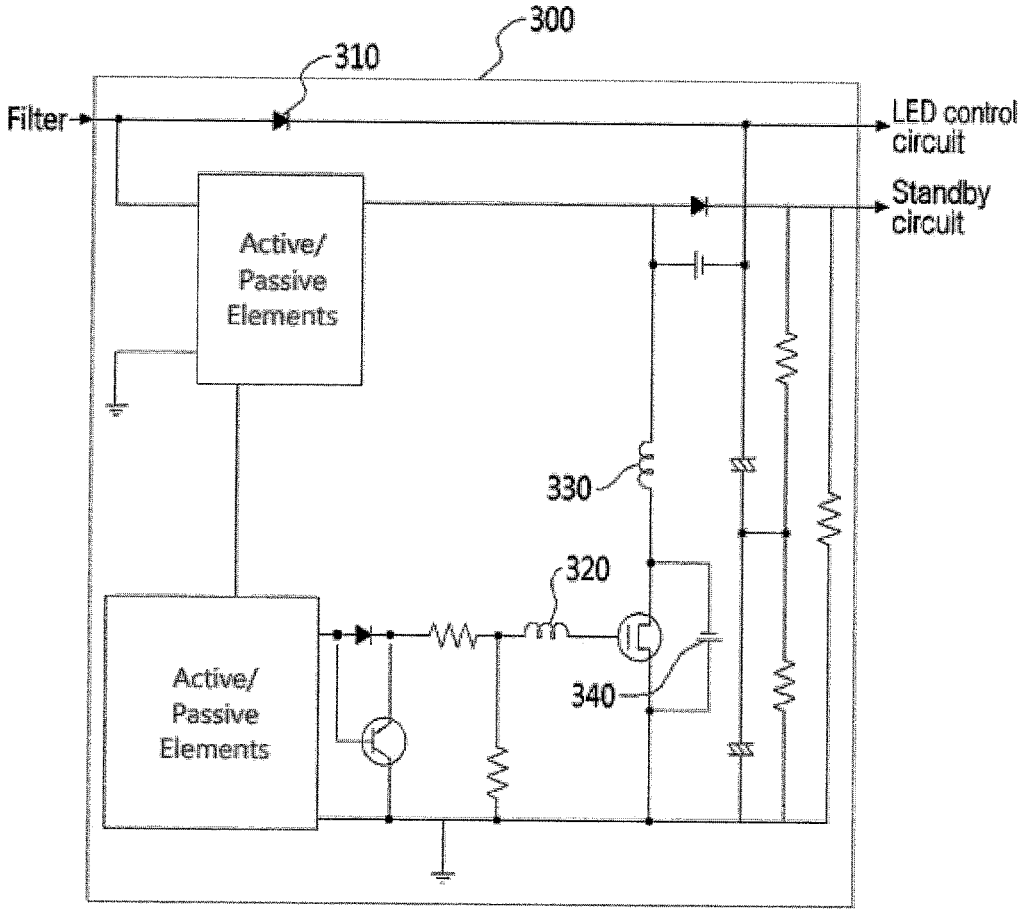
FIG. 2 is a circuit diagram showing a power factor correction circuit within the power apparatus for an LED light according to the present invention.

In an embodiment of the present invention, a power apparatus for an LED light includes the power factor correction circuit 300. FIG. 2 is a circuit diagram showing the power factor correction circuit 300 within the power apparatus for an LED light according to the present invention.

The power factor correction circuit 300 within the power apparatus for an LED light according to the present invention includes various active and passive elements. In particular, elements related to the objects to be achieved in the present invention within the power factor correction circuit 300 configured by electrically connecting various resistors, inductors, capacitors, transistors, and electronic chips are chiefly described.

The power factor correction circuit 300 within the power apparatus for an LED light according to the present invention further includes a bypass element 310 between an input stage and an output stage. The bypass element 310 is described in more detail with reference to FIG. 3.

Figure 3:
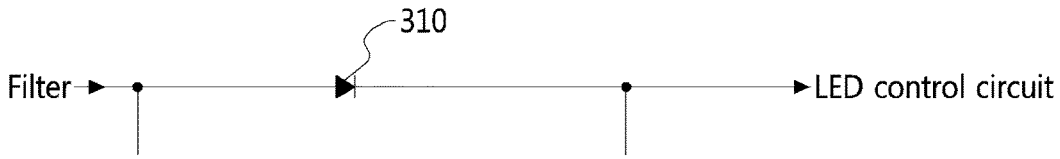
FIG. 3 is an enlarged circuit diagram of a bypass element portion within the power apparatus for an LED light according to the present invention.

FIG. 3 is an enlarged circuit diagram of the bypass element (310) portion within the power apparatus for an LED light according to the present invention.

From FIG. 3, it may be seen that the bypass element 310 has been inserted between the input stage and output stage of the power factor correction circuit 300. The input stage of the power factor correction circuit 300 is an input stage placed in the path along which input power is received via the filter 100 and the rectifier 200. This may be checked with reference to FIG. 1. The output stage of the power factor correction circuit 300 is a node connected to the LED control circuit 400. This may also be checked with reference to FIG. 1.

The separate bypass element 310 is not present between the input stage and output stage of the power factor correction circuit 300 within a conventional power apparatus for an LED light. Referring to FIG. 3, in the conventional power apparatus for an LED light, both ends of the inserted bypass element 310 have an open form.

However, the present invention has a form further including one path connected through the medium of the bypass element 310 between the input stage and the output stage compared to a related art. In accordance with such a structure, the present invention can improve surge immunity.

A surge is an excessive abnormal voltage which is generated and invaded through a conductor, such as the power line, communication line, signal line, etc. of a power system. A lot of damage, such as damage to an electrical device and an electronic part and the malfunction of software, is caused due to the invasion of a surge. The type of a surge chiefly includes a surge that is naturally generated and a surge that is generated by switching, etc. The surge that is naturally generated includes direct lightning that is a surge in which lightning directly attacks a structure, equipment, a power line, etc., indirect lightning that is a surge delivered through a power line or a communication line, induced lightning that is a surge induced through a buried power line or a communication line, and so on. The surge that is generated by switching, etc. includes an opening and shutting surge generated by a moving load or the opening and shutting of an electrical device, a start-up surge generated when power switches by an inverter, and so on.

The surge also leads to a severe problem for the power apparatus for an LED light according to the present invention. In order to improve such a problem, the power factor correction circuit 300 within the power apparatus for an LED light according to the present invention has the separate bypass element 310 inserted between the input stage and the output stage. As a result, when an unexpected surge is inputted, a high voltage is not induced into other elements within the power factor correction circuit 300, but may be externally discharged through the bypass circuit. In particular, an in-rush surge generated when the power apparatus for an LED light is initially driven is made flow.

Meanwhile, in an embodiment of the present invention, the bypass element 310 may be a rectifier element. A rectifier element, in particular, a diode functions as the bypass element 310. The rectifier element can withstand a surge voltage and surge current that is suddenly induced because it is excellent in the voltage withstand capability, thus being capable of improving surge immunity of the power apparatus for an LED light.

In another embodiment of the present invention, a bead 320 may be connected to the gate of a switching element included the power factor correction circuit 3. The present embodiment is described with reference to FIGS. 2 and 4.

Figure 4:
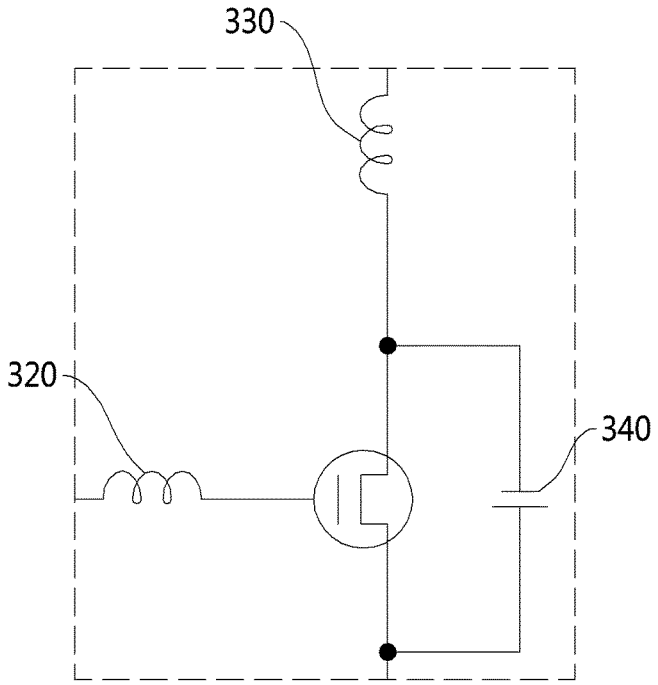
FIG. 4 is an enlarged circuit diagram of a switching element and a bead within the power apparatus for an LED light according to the present invention.

FIG. 4 is an enlarged circuit diagram of the switching element and the bead 320, 330, 340 within the power apparatus for an LED light according to the present invention.

From FIG. 4, it may be seen that the bead 320 is connected to the gate G of an FET element. The switching element of the power factor correction circuit 300 included in a conventional power apparatus for an LED light is only directly connected to another element, but is not connected to a bead, such as that of the present invention. In the present invention, however, the bead 320 is included in the gate, that is, the input stage of the switching element, thereby preventing noise from being induced into the input stage of the switching element. In particular, the bead 320 functions as a kind of filter 100 for filtering electromagnetic interference (EMI), and thus improves the EMI of the power factor correction circuit 300 and the entire power apparatus for an LED light. For example, an inductance element may be used as the bead 320. For more specific example, if a ferrite bead is used, high-frequency noise can be effectively removed using a self-attenuation effect specific to ferrite.

In another embodiment of the present invention, the bead 330 may also be connected to the drain of the switching element. Even in the present embodiment, this may be checked with reference to FIG. 4. From FIG. 4 showing an enlarged view of the switching element portion in the power factor correction circuit 300 of the present invention, it may be seen that the separate bead 330 is connected to the drain D of the FET element. The drain of the switching element of the power factor correction circuit 300 within a conventional power apparatus for an LED light is only directly connected to another element, but is not connected to a separate bead. In the present invention, however, the bead 330 is included in the drain of the switching element, thereby being capable of blocking noise which may occur in delivering power to a power capacitor connected to the switching element. In particular, the bead 330 enhances EMI performance of the power factor correction circuit 300 and the power apparatus for an LED light by blocking EMI. For example, an inductance element may be used as the bead. For more specific example, if a ferrite bead is used, high-frequency noise can be effectively removed using a self-attenuation effect specific to ferrite.

In another embodiment of the present invention, the bead 340 may be connected between the drain and source of the switching element included in the power factor correction circuit 300. In the present embodiment, referring to FIG. 4, the separate capacitance element 340 is connected between the drain D and source S of the FET element.

The capacitance element of the present invention operates a kind of high pass filter (HPF) that transmits a high-frequency AC component, and allows a high-frequency noise signal or EMI signal which may occur in the power factor correction circuit 300 to flow into a ground terminal through the capacitance element 340. Accordingly, EMI or high-frequency noise is not induced into the LED control circuit 400 and the LED.

Figure 5:
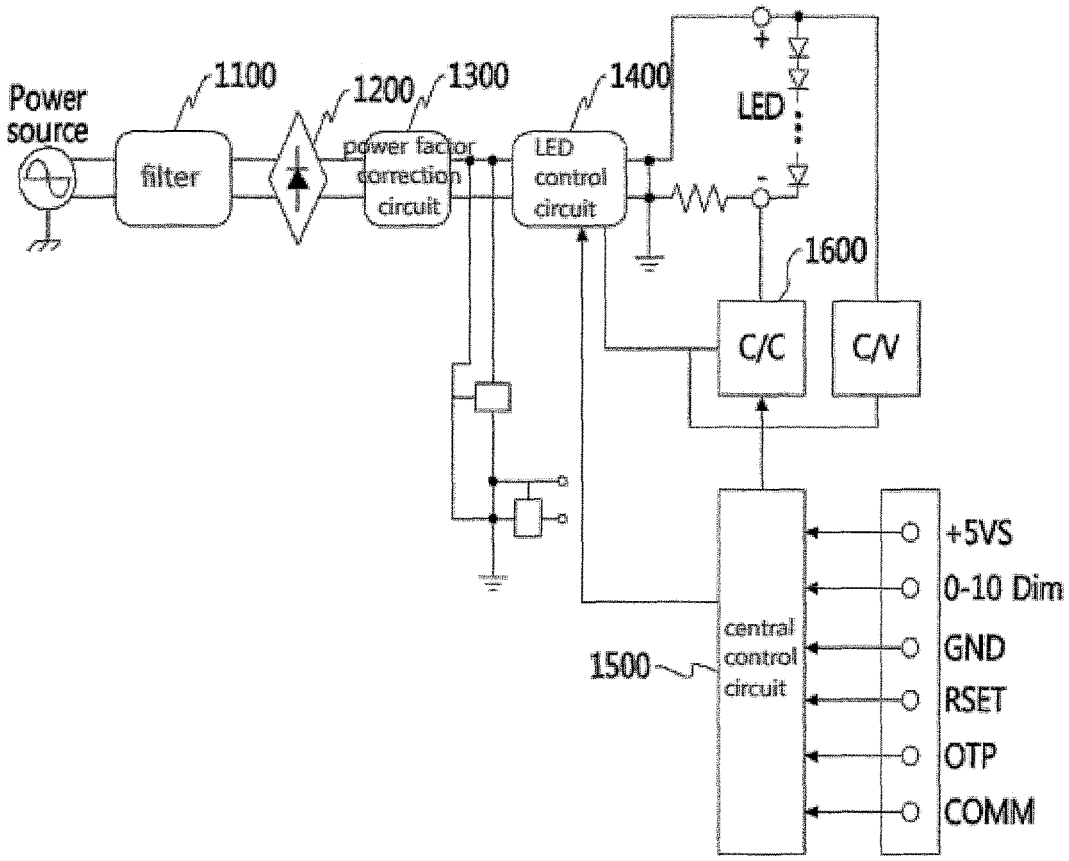
FIG. 5 is a block diagram showing the structure of a power apparatus for an LED light according to an embodiment of the present invention.

FIG. 5 is a block diagram showing the structure of a power apparatus for an LED light according to an embodiment of the present invention.

The power apparatus for an LED light according to the present invention includes a filter 1100 which blocks noise of input AC power, a rectifier 1200 which is connected to the filter 1100 and converts AC power into DC power, a power factor correction circuit 1300 which controls the power factor of power received from the rectifier 1200, a central control circuit 1500 which controls the operation of the power apparatus for an LED light, an LED control circuit 1400 which controls power inputted via the power factor correction circuit 1300 and provides the controlled power to an LED, and a current conversion circuit 1600 which senses the electric current of the LED and transmits the sensed current to the LED control circuit 1400.

The filter 1100 of the present invention is an element for blocking noise included in power (commercialized power is AC power) received from the outside. The power apparatus for an LED light according to the present invention controls various operations, such as the ON/OFF of the LED, using commercialized AC power. The LED is driven by DC power. That is, there is a need for a process for converting the AC power into the DC power. Prior to the power conversion, noise of various components included in the AC power is removed so that power is efficiently converted. Furthermore, damage to parts of the power apparatus attributable to a noise signal is prevented by preventing a variety of types of noise, transferred by a system, from entering a power apparatus for an LED light.

The rectifier 1200 of the present invention is a device for converting AC power into DC power. As described above, an LED light is driven by DC power, but commercialized power is AC power. Accordingly, commercialized power needs to be converted into DC power. To this end, the present invention includes the rectifier 1200. The rectifier 1200 of the present invention may be implemented in various forms of rectifier elements, such as a half-bridge rectifier and a full-bridge rectifier.

The power factor correction circuit 1300 of the present invention is an element for improving efficiency of input versus output by improving the power factor of the entire circuit. Furthermore, the power factor correction circuit 1300 is an element for delivering an insulated voltage to the LED control circuit 1400.

The power factor correction circuit 1300 of the present invention may be implemented using a flyback circuit, but is not limited thereto. A device having the same function should be considered to be included in the power factor correction circuit 1300 written in the claims of the present invention.

The central control circuit 1500 of the present invention is an element for controlling an overall operation of the power apparatus for an LED light. The central control circuit 1500 executes various functions, such as whether the LED is to be driven, the brightness of the LED, and communication with the outside in response to a user's input. In particular, the central control circuit 1500 functions to generally manage the operation of the power apparatus by receiving information about the operating state of each element within the power apparatus and controlling each element. The central control circuit 1500 may be implemented through a control device, such as a microcomputer.

The LED control circuit 1400 is an element for controlling power provided to the LED via the power factor correction circuit 1300 in response to a signal received from the central control circuit 1500. The amount of LED power inputted via the power factor correction circuit 1300 may be greater or smaller than driving power of the LED (generally, greater). The LED control circuit 1400 converts the LED power into a degree suitable for driving the LED by adjusting the scale of the LED power, for example, by a DC-DC conversion and supplies the converted power to the LED. Furthermore, the LED control circuit 1400 controls whether the LED is to be driven, the brightness of the LED, and the driving time of the LED in response to a signal received from the central control circuit 1500.

The current conversion circuit 1600 is an element for sensing the electric current of the LED and transmitting the sensed current to the LED control circuit 1400. The current conversion circuit 1600 is an element for adjusting an electric current, received from the LED, to the level of a voltage capable of being processed by the LED control circuit 1400 by processing the electric current.

The current conversion circuit 1600 is described in more detail.

Figure 6:
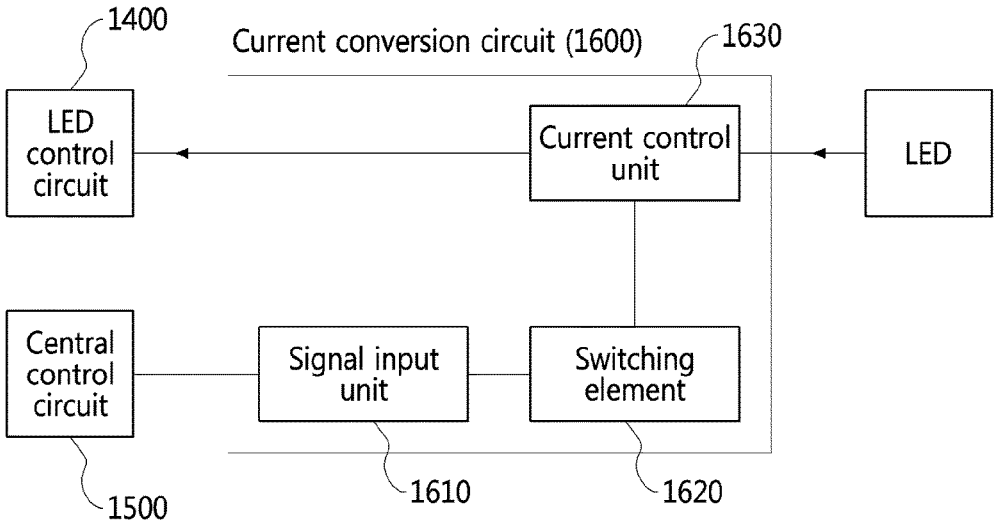
FIG. 6 is a block diagram showing a current conversion circuit within the power apparatus for an LED light according to the present invention.

FIG. 6 is a block diagram showing the current conversion circuit 1600 within the power apparatus for an LED light according to the present invention. The current conversion circuit 1600 within the power apparatus for an LED light according to the present invention includes a signal input unit 1610 which receives a PWM signal from the central control circuit 1500, a switching element 1620 which operates in response to the PWM signal received from the signal input unit 1610, and a current control unit 1630 which is connected to the switching element 1620, processes an electric current received from the LED in response to an operation of the switching element 1620, and transmits the processed current to the LED control circuit 1400.

The signal input unit 1610 is connected to the central control circuit 1500, and functions as a passage which receives a signal received from the central control circuit 1500. The central control circuit 1500 controls the current conversion circuit 1600 using a pulse width modulation (PWM) signal and thus controls the level of a voltage at a specific terminal of the LED control circuit 1400 and an electric current induced into the LED control circuit 1400. The signal input unit 1610 receives a PWM signal from the central control circuit 1500 so that the switching element 1620 operates. The operation of the current conversion circuit 1600 according to the PWM signal is described later.

The switching element 1620 is an element which is turned on/off in response to the PWM signal received from the signal input unit 1610. More specifically, the degree that the switching element 1620 is turned on/off is controlled in response to the PWM signal. Accordingly, an electric current at the rear stage (e.g., the current control unit 1630) of the switching element 1620 and a corresponding voltage level are adjusted.

The current control unit 1630 is connected to the switching element 1620. In particular, the current control unit 1630 processes an electric current sensed from the LED in response to the ON/OFF operation of the switching element 1620 and transmits the processed current to the LED control circuit 1400. As described above, the current conversion circuit 1600 of the present invention enables a specific terminal of the LED control circuit 1400 which needs to always maintain a constant level to maintain a specific voltage and also enables the amount of an electric current flowing into the LED to be controlled. Brightness of the LED can be adjusted by such an operation.

The present invention is described in more detail below through a circuit diagram according to an embodiment of the current conversion circuit 1600.

Figure 7:
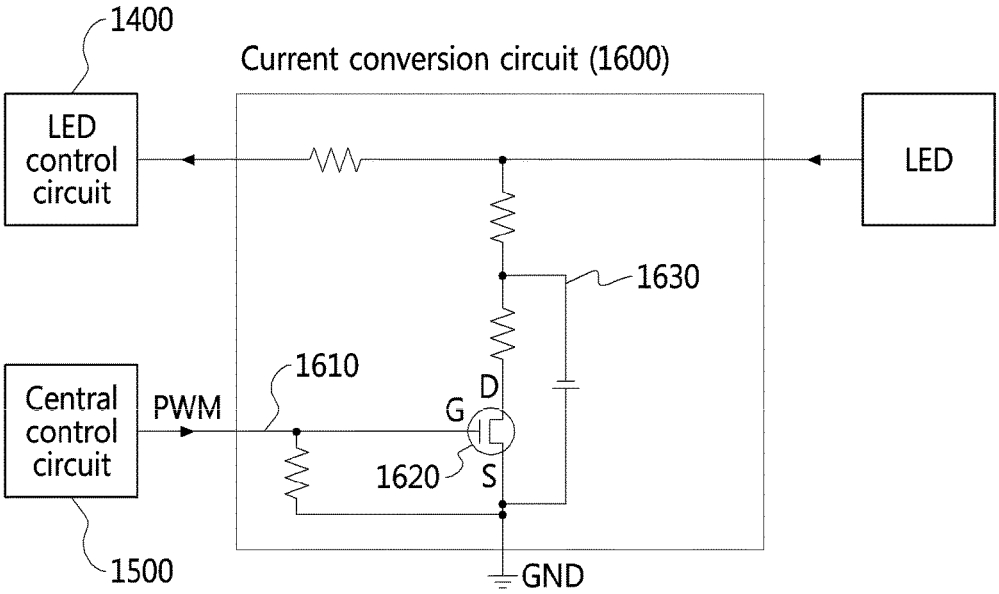
FIG. 7 is a circuit diagram showing a current conversion circuit within the power apparatus for an LED light according to the present invention.

FIG. 7 is a circuit diagram showing the current conversion circuit 1600 within the power apparatus for an LED light according to the present invention.

In an embodiment of the present invention, the switching element 1620 may be configured using an FET element. FIG. 7 shows an FET element according to the aforementioned example. The degree that a channel is formed between the drain and source of the FET element is different in response to a signal inputted to the gate of the FET element. Whether an electric current or a voltage is applied and the degree that an electric current or a voltage is applied are determined by the degree that the channel is formed. Accordingly, as in the present invention, the switching element 1620 is suitable for controlling the circuit in response to a received PWM signal.

Meanwhile, in this case, the signal input unit 1610 shown in FIG. 6 is connected to the gate terminal of the FET element. Accordingly, a signal received from the central control circuit 1500 may be directly delivered to the switching element 1620.

In the present embodiment, the signal input unit 1610 and the switching element 1620 must not be physically separated. The gate terminal of the FET element used as the switching element 1620 may be considered to be the signal input unit 1610. A separate element directly connected to the gate terminal of the FET element, for example, a separate port connected by a conducting wire on a printed circuit board may become the signal input unit 1610. That is, the signal input unit 1610 and the switching element 1620 are divided depending on their functions, but do not need to be independent elements on the outward appearance.

Meanwhile, in addition to the aforementioned embodiment, a resistor may be further included between the signal input unit 1610 of the present invention and a ground terminal. A resistor connected between the gate terminal of the FET element and the ground terminal in FIG. 7 corresponds to such a resistor.

A rated voltage with which the gate terminal of the FET element can be driven may be adjusted by the resistor. That is, the current conversion circuit 1600 of the present invention may further include the aforementioned resistor in order to maintain a bias voltage that is necessary for the FET element (i.e., the switching element) to correctly operate. Accordingly, the switching element 1620 operates within a stable range.

In another embodiment of the present invention, the current control unit 1630 may include a plurality of resistors. The plurality of resistors is connected between a node connected to the drain terminal of the FET element and a node which receives an electric current from the LED or the node which receives the electric current and a node connected to the LED control circuit 1400.

The present embodiment is an element for adjusting the level of a voltage output to the LED control circuit 1400. A terminal that belongs to the LED control circuit 1400 of the present invention and that is connected to the current conversion circuit 1600 needs to maintain a specific voltage (e.g., 1 V) or needs to be controlled so that it has the specific voltage (this is caused by an electric characteristic of the LED control circuit 1400). If an electric current induced from the LED is directly connected to the LED control circuit 1400 without the intervention of the current conversion circuit 1600, a specific terminal of the LED control circuit 1400 which needs to maintain a constant voltage may deviate from the specific voltage range. The reason for this is that there is no element capable of controlling a voltage.

In the present invention, however, the plurality of resistors is connected in series within the current control unit 1630 (in the example of FIG. 7, three resistors are connect in series) and is also connected to the drain terminal of the switching element 1620 in series. Accordingly, the voltages of the resistors and the level of a voltage at a specific terminal of the LED control circuit 1400 can be adjusted under the control of the switching element 1620.

The aforementioned voltage control may not be actively performed by an IC circuit, such as the LED control circuit 1400. In the present invention, however, such voltage control may be performed using the current conversion circuit 1600.

Meanwhile, the level of a voltage inputted to the LED control circuit 1400 may be adjusted by adjusting a point at which the resistor and the LED are connected or the size of the resistor.

In another embodiment of the present invention, a capacitance element may be included between the drain terminal of the FET element and the ground terminal. The capacitance element may also be checked with reference to FIG. 7.

In the present invention, the capacitance element is connected to the drain of the FET element and the ground terminal (or the source). The aforementioned capacitance element operates as a kind of high pass filter (HPF) that transmits a high frequency AC component. The capacitance elements allows a high-frequency noise signal, generated while power received from the LED or the PWM signal passes through the FET element, to flow into the ground terminal through the capacitance element.

Accordingly, a voltage and current of a DC component are delivered to the LED control circuit 1400, and thus the LED can be controlled by the voltage and current.

In the current conversion circuit 1600 of the present invention, the duty ratio of the PWM signal received through the signal input unit 1610 is adjusted by the central control circuit 1500. The switching element 1620 controls ON/OFF in response to the PWM signal having an adjusted duty ratio. The current control unit 1630 may control an electric current inputted to the LED control circuit 1400 in response to the ON/OFF of the switching element 1620. This is described with reference to FIG. 8.

Figure 8:
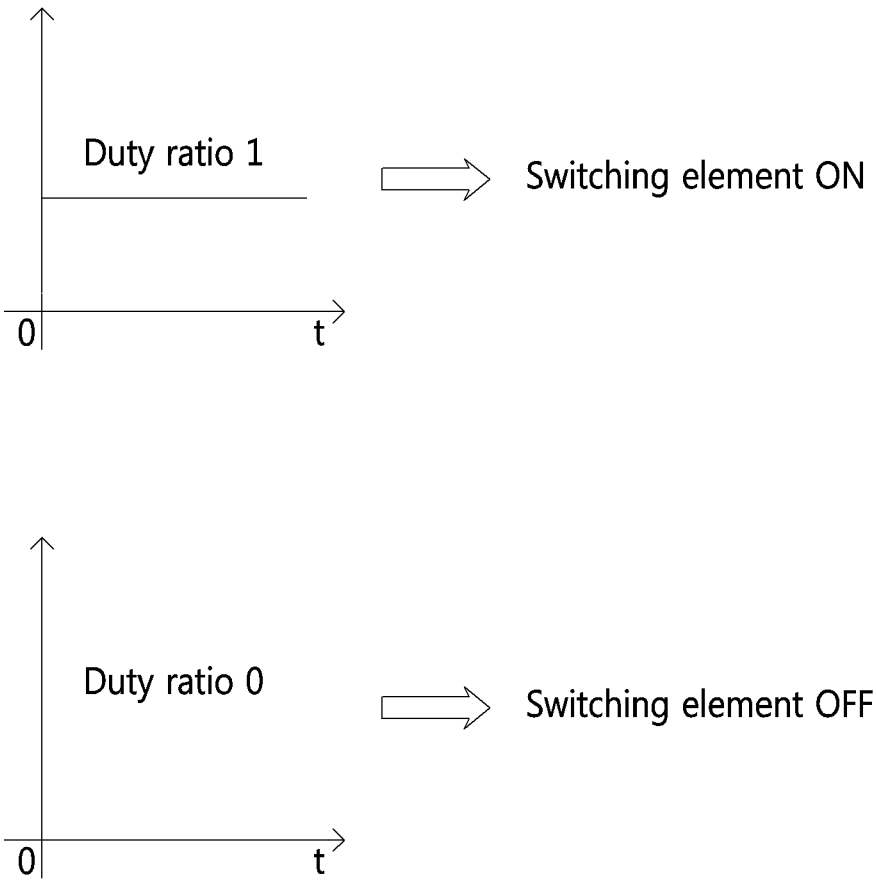
FIG. 8 is a graph conceptually illustrating the operation of the current conversion circuit according to a PWM signal inputted to the power apparatus for an LED light according to the present invention.

FIG. 8 is a graph conceptually illustrating the operation of the current conversion circuit 1600 according to the PWM signal inputted to the power apparatus for an LED light according to the present invention.

In the present invention, the operation of the switching element 1620 may be controlled in response to the duty ratio of the PWM signal received from the central control circuit 1500. The levels of an electric current and voltage induced from the current control unit 1630 to the LED control circuit 1400 can be adjusted by such a control operation.

As shown in FIG. 8, if the duty ratio is 0, the switching element 1620 is off, and thus an electric current received from the LED is not inputted to the switching element 1620, but is inputted to the LED control circuit 1400 without any change. In contrast, if the duty ratio is 1, the switching element 1620 is fully on, and thus some of an electric current received from the LED flows through the switching element 1620. The electric current flows along the switching element 1620 and the resistors of the current control unit 1630, thereby generating a constant voltage level. Accordingly, the LED control circuit 1400 may maintain a constant voltage. That is, the voltage of a node at which the LED control circuit 1400 and the current conversion circuit 1600 are connected is determined by the duty ratio of the PWM signal. Operations in the upper limit 1 and lowest limit 0 of the duty ratio are the same as those described above. If the duty ratio is controlled within the upper limit and lowest limit range (more than 0 to less than 1), it may be controlled between the state in which the switch fully becomes ON and the state in which the switch fully becomes OFF. As a result, the voltage of the node (a constant voltage level needs to be maintained) can be controlled. In addition, the amount of an electric current flowing into the LED can be controlled.

As a result, in accordance with the present invention, matters that may not be implemented in an IC circuit (an always constant voltage level is maintained in a specific terminal of the LED control circuit 1400) can be implemented using a special circuit configuration (the current conversion circuit 1600) and a PWM control method. As a result, the power apparatus for an LED light can be stably driven.

Figure 9:
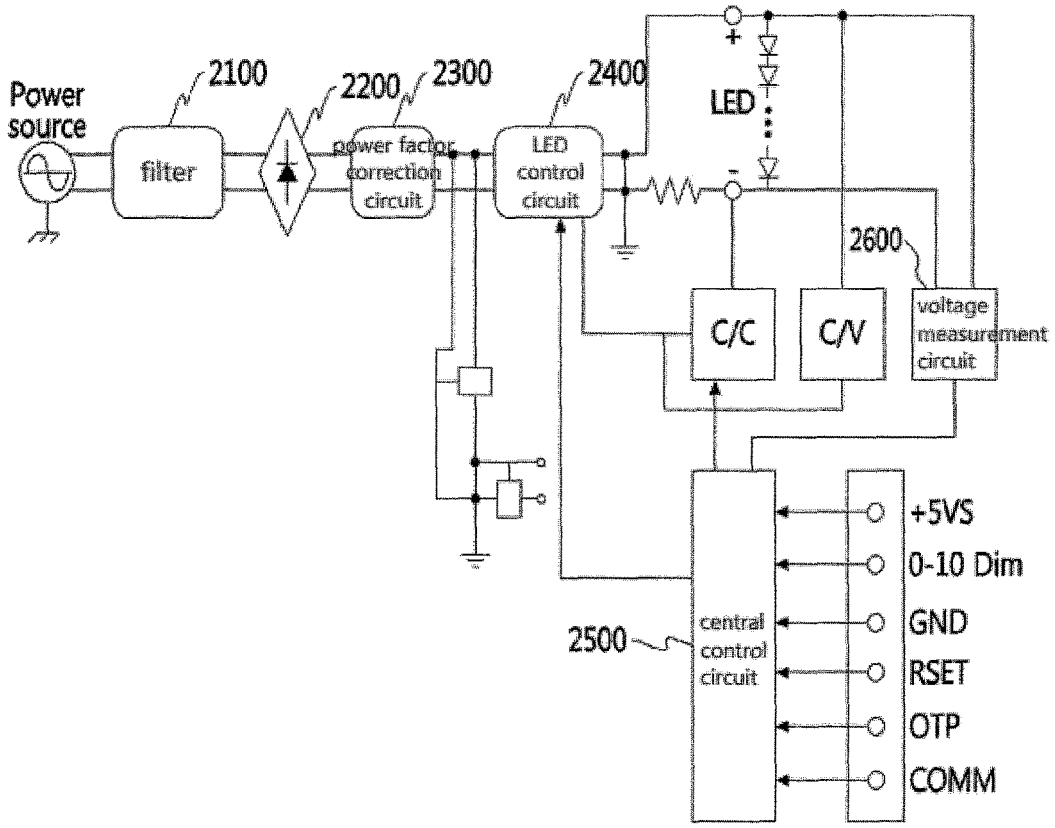
FIG. 9 is a block diagram showing the structure of a power apparatus for an LED light according to an embodiment of the present invention.

FIG. 9 is a block diagram showing the structure of a power apparatus for an LED light according to an embodiment of the present invention.

The power apparatus for an LED light according to the present invention includes a filter 2100 which blocks noise of input AC power, a rectifier 2200 which is connected to the filter 2100 and converts AC power into DC power, a power factor correction circuit 2300 which controls the power factor of power received from the rectifier 2200, a central control circuit 2500 which controls the operation of the power apparatus for an LED light, an LED control circuit 2400 which adjusts power received via the power factor correction circuit 2300 and provides the adjusted power to an LED, and a voltage measurement circuit 2600 which senses the voltage of the LED and transmits the sensed voltage to the central control circuit 2500.

The filter 2100 of the present invention is an element for blocking noise included in power (commercialized power is AC power) received from the outside. The power apparatus for an LED light according to the present invention controls various operations, such as the ON/OFF of the LED, using commercialized AC power. The LED is driven by DC power. That is, there is a need for a process for converting the AC power into the DC power. Prior to the power conversion, noise of various components included in the AC power is removed so that power is efficiently converted. Furthermore, damage to parts of the power apparatus attributable to a noise signal is prevented by preventing a variety of types of noise, transferred by a system, from entering a power apparatus for an LED light.

The rectifier 2200 of the present invention is a device for converting AC power into DC power. As described above, an LED light is driven by DC power, but commercialized power is AC power. Accordingly, commercialized power needs to be converted into DC power. To this end, the present invention includes the rectifier 2200. The rectifier 2200 of the present invention may be implemented in various forms of rectifier elements, such as a half-bridge rectifier and a full-bridge rectifier.

The power factor correction circuit 2300 of the present invention is an element for improving efficiency of input versus output by improving the power factor of the entire circuit. Furthermore, the power factor correction circuit 2300 is an element for delivering an insulated voltage to the LED control circuit 2400.

The power factor correction circuit 2300 of the present invention may be implemented using a flyback circuit, but is not limited thereto. A device having the same function should be considered to be included in the power factor correction circuit 2300 written in the claims of the present invention.

The central control circuit 2500 of the present invention is an element for controlling an overall operation of the power apparatus for an LED light. The central control circuit 2500 executes various functions, such as whether the LED is to be driven, the brightness of the LED, and communication with the outside in response to a user's input. In particular, the central control circuit 2500 functions to generally manage the operation of the power apparatus by receiving information about the operating state of each element within the power apparatus and controlling each element. The central control circuit 2500 may be implemented through a control device, such as a microcomputer.

The LED control circuit 2400 is an element for controlling power provided to the LED via the power factor correction circuit 2300 in response to a signal received from the central control circuit 2500. The amount of LED power inputted via the power factor correction circuit 2300 may be greater or smaller than driving power of the LED (generally, greater). The LED control circuit 2400 converts the LED power into a degree suitable for driving the LED by adjusting the scale of the LED power, for example, by a DC-DC conversion and supplies the converted power to the LED. Furthermore, the LED control circuit 2400 controls whether the LED is to be driven, the brightness of the LED, and the driving time of the LED in response to a signal received from the central control circuit 2500.

The voltage measurement circuit 2600 senses the voltage of the LED and transmits the sensed voltage to the central control circuit 2500. Rated power of the power apparatus for an LED light is determined by an electric current and a voltage which flow into the LED. If the LED consumes power greater than rated power, a trouble is generated or lift span is reduced because an excessive load is applied to the LED. Accordingly, it is necessary to precisely measure and control the voltage and current of the LED so that the LED consumes power of rated power or less. The voltage measurement circuit 2600 of the present invention performs control so that an electric current suitable for a measured voltage flows into the LED by precisely sensing the voltage of the LED and transmitting the sensed voltage to the central control circuit 2500. As a result, the LED can be driven within a rated power range.

The voltage measurement circuit 2600 is described in more detail below.

FIG. 10 is a block diagram showing the voltage measurement circuit 2600 within the power apparatus for an LED light according to the present invention.

The voltage measurement circuit 2600 within the power apparatus for an LED light according to an embodiment of the present invention includes a first sensing unit 2610 which senses a voltage at the positive pole of the LED, a second sensing unit 2620 which senses a voltage at the negative pole of the LED, and a comparison unit 2630 which compares a result of the voltage sensing of the sensing of the first sensing unit 2610 with a result of the voltage sensing of the second sensing unit 2620.

Figure 13:
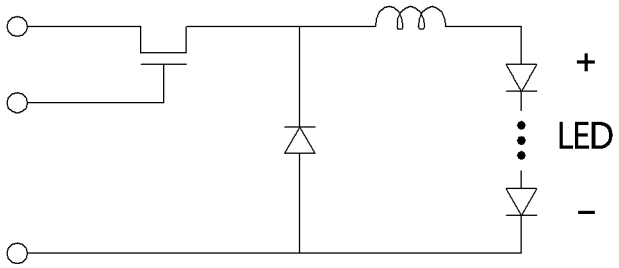
FIG. 13 is a circuit diagram showing a conventional method for measuring the voltage of an LED.
Figure 13:
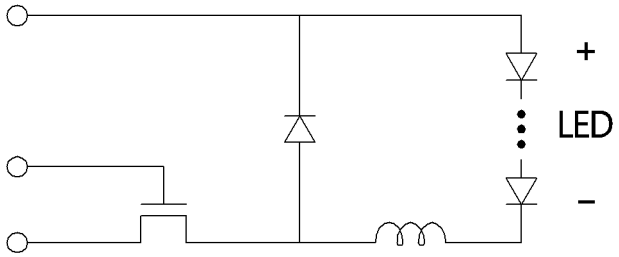

In the present invention, in measuring the voltage of an LED, voltages at the positive pole and negative pole of the LED are measured. A conventional method for measuring voltages at both ends of an LED is a method for measuring a floating voltage. The conventional method is described below with reference to FIG. 13. When measuring the voltage of an LED, a voltage (a floating voltage) in either a negative pole or a positive pole is measured. FIG. 13 shows an example in which the voltage of a positive pole is measured and an example in which the voltage of a negative pole is measured. However, the conventional method is problematic in that a voltage measurement is influenced by another circuit element added and connected to an LED. Referring to FIG. 13, the voltage of an LED, including a voltage applied to an inductor connected to the high side (FIG. 13(*a*)) or the low side (FIG. 13(*b*)), is measured. The LED is driven by DC power and a DC voltage across the inductor is ideally 0, but a voltage may also be applied across the inductor because an AC component attributable to the fluctuation of an electric current, the generation of a ripple, etc. is added. The conventional method has a problem in that such a voltage is measured as the voltage of the LED.

In order to improve such a problem, in the present invention, elements (the first sensing unit 2610 and the second sensing unit 2620) for sensing voltages are connected to both ends of the LED, that is, the positive pole and the negative pole. That is, not a floating voltage, but voltages on both sides are measured, and the voltage of the LED is measured using the measured voltages. Accordingly, the voltage of the LED can be measured more precisely compared to a conventional method, the LED can be controlled within a rated power range so that it has maximum efficiency, and the lifespan of the LED can be extended by reducing a load of the LED.

Detailed embodiments of the present invention are described in detail below with reference to FIGS. 11 and 12.

FIG. 11 is a circuit diagram showing the first sensing unit 2610 and second sensing unit 2620 of the voltage measurement circuit 2600 within the power apparatus for an LED light according to the present invention.

An embodiment of the first sensing unit 2610 or second sensing unit 2620 of the present invention may further include a rectifying unit for filtering a positive voltage.

The rectifying unit is an element for filtering only a positive voltage (+voltage) of voltages at both ends of the LED in addition to a function for sensing an output voltage and transmitting the sensed voltage to the comparison unit 2630. For example, a diode element may be used as the rectifying unit. Voltage levels at both ends of the LED, that is, the positive pole and negative pole of the LED, respectively, are sensed using the diode element. The diode element becomes conductive only when a sensed voltage is a positive voltage. When the diode element becomes ON, the level of a voltage is delivered to the comparison unit 2630.

Meanwhile, the first sensing unit 2610 or second sensing unit 2620 of the present invention may further include a voltage adjustment unit for adjusting the amount of a sensed voltage. The voltage adjustment unit is an element for allowing a voltage to be delivered within the range in which the voltage can be processed by the comparison unit 2630 and can be processed by the central control circuit 2500 after the voltage is processed by the comparison unit 2630.

If voltages at both ends of the LED is sensed and directly transmitted to the comparison unit 2630 and the central control circuit 2500 is driven without the voltage adjustment unit, the voltages at both ends of the LED are unable to be handled by the central control circuit 2500 if the voltages become very greater. The reason for this is that the central control circuit 2500 is a digital circuit and has a determined driving power Vcc and a limited current/voltage range capable of being processed by the central control circuit 2500. Accordingly, in the present invention, the voltage adjustment unit is further included in the first sensing unit 2610 or the second sensing unit 2620. The voltage adjustment unit adjusts the level of a voltage to the range in which the voltage can be processed by the comparison unit 2630 or the central control circuit 2500.

As an example in which the voltage adjustment unit is implemented, a plurality of resistors may be connected in series, and a specific node may be selected and connected to the comparison unit 2630. In the example of FIG. 11, the first sensing unit 2610 implements the voltage adjustment unit using three resistors, and the second sensing unit 2620 implements the voltage adjustment unit using two resistors. The first sensing unit 2610 and the second sensing unit 2620 do not need to adjust a voltage at the same ratio always. If each of the first sensing unit 2610 and the second sensing unit 2620 stores information about the ratio to which a voltage has been adjusted in the central control circuit 2500 and the central control circuit 2500 subsequently calculates voltages at both ends of the LED by incorporating the information into the voltages at both ends of the LED, the central control circuit 2500 may precisely calculate the voltages at both ends of the LED although the ratios to which the voltages has been adjusted by the first and the second sensing units are different. The size and voltage adjustment ratio of each of the plurality of resistors connected in series may be differently determined depending on performance of the LED and the specifications of the comparison unit 2630 and the central control circuit 2500.

Meanwhile, in another embodiment of the present invention, the first sensing unit 2610 or the second sensing unit 2620 may further include a smoothing unit for smoothing a sensed voltage. The smoothing unit is an element for handling a voltage unexpectedly generated across the LED, the fluctuation of an electric current, and a ripple. It is ideal that a voltage and current across the LED includes only a DC component, but includes a voltage and current of an AC component due to several reasons while the power apparatus for an LED light is driven. In this case, the accuracy of a voltage level sensed by the first or the second sensing unit is reduced, and the driving of the central control circuit 2500 also becomes unstable because a voltage level is greatly changed for a short time.

In order to solve such problems, the present invention may further include the smoothing unit and further includes a capacitance element as an example of the smoothing unit so that an AC component of the voltage of the LED does not flow into the comparison unit 2630 and the central control circuit 2500.

Figure 12:
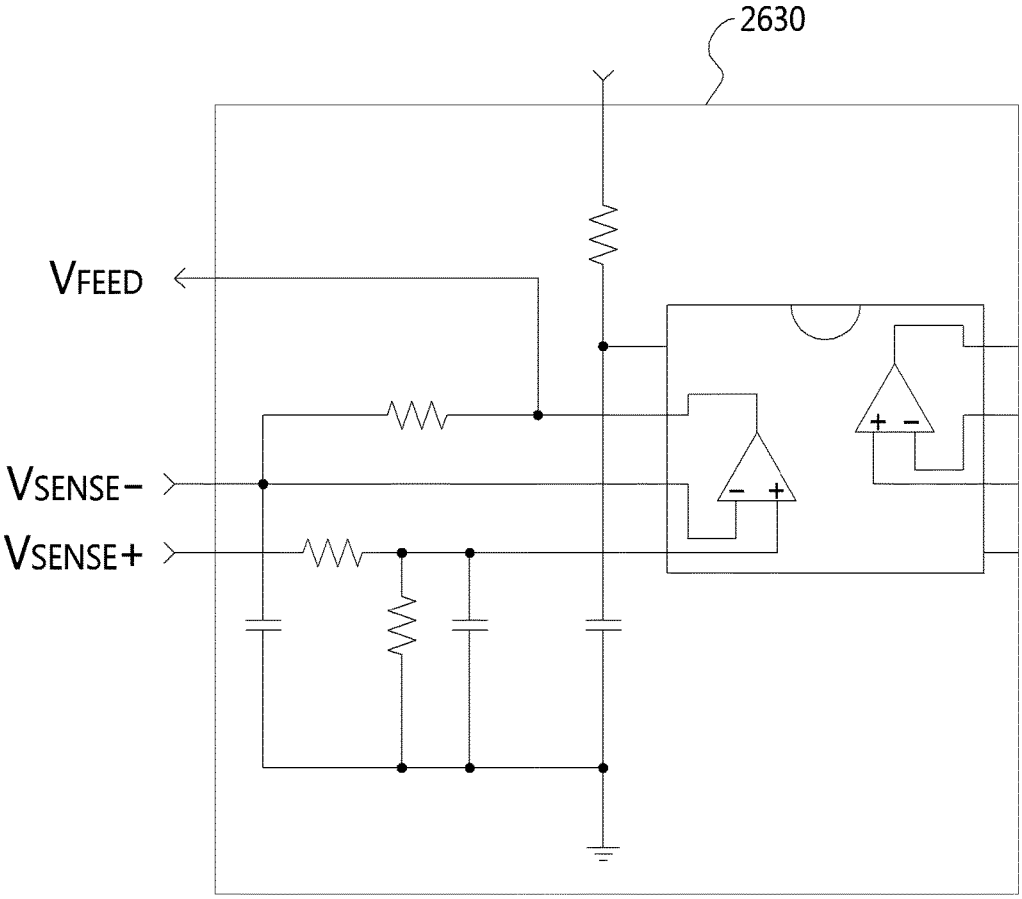
FIG. 12 is a circuit diagram showing the comparison unit of the voltage measurement circuit within the power apparatus for an LED light according to the present invention.

FIG. 12 is a circuit diagram showing the comparison unit 2630 of the voltage measurement circuit 2600 within the power apparatus for an LED light according to the present invention.

The comparison unit 2630 according to an embodiment of the present invention is implemented by a differential amplification circuit. Voltage levels sensed by the first sensing unit 2610 and the second sensing unit 2620, respectively, are inputted to the two input stages of the differential amplification circuit. The differential amplification circuit amplifies the voltages at a predetermined amplification ratio (the amplification ratio may be + or −). The amplified voltages are output to the central control circuit 2500. The central control circuit 2500 calculates a voltage across the LED based on a voltage received from the comparison unit 2630.

Meanwhile, the central control circuit 2500 may directly calculate a voltage across the LED, and may previously store the relation between a voltage received from the comparison unit 2630 and a voltage across the LED in a table form and derive a voltage across the LED by matching the relation with the voltage received from the comparison unit 2630.

The central control circuit 2500 adjusts the level of an electric current flowing through the LED in response to a voltage across the LED. That is, if a voltage across the LED is high, the central control circuit 2500 controls the entire power level (a voltage*current) so that it is maintained within a constant range by lowering the level of an electric current flowing through the LED. If a voltage across the LED is low, however, the central control circuit 2500 controls the entire power level so that it is maintained within a constant range by raising the level of an electric current flowing through the LED.

The reason why such control is performed is that an electric current across the LED is able to be controlled, but a voltage across the LED is unable to be controlled. A voltage across the LED is a factor determined depending on the characteristics of the LED, the amount of current, etc. and is unable to be controlled by a user actively and accurately. However, an electric current flowing through the LED may be controlled by a separate element (not described in detail in this specification) within the power apparatus for an LED light, and thus power of the LED is controlled by controlling the electric current.

In accordance with the present invention, the power apparatus for an LED light can be protected and the life span of the power apparatus can be increased by improving surge immunity of the power apparatus for an LED light.

Performance of the power apparatus for an LED light can be improved by reducing electromagnetic interference (EMI).

The present invention can effectively control a digital circuit by control of PWM that belongs to functions necessary to control the power apparatus for an LED light and that uses an analog circuit.

A voltage across an LED can be precisely measured, and the power apparatus for an LED light can be stably controlled based on the measured voltage.

An error in measurement which is attributable to high-frequency noise can be prevented, and a voltage level and a current level can be processed within the driving range of the power apparatus for an LED light.

What is claimed is:

1. A power apparatus for an LED light, comprising:

a filter which blocks noise of input AC power;

a rectifier which is connected to the filter and converts the AC power into DC power;

a power factor correction circuit which controls a power factor of power received from the rectifier;

a central control circuit which controls an operation of the power apparatus for an LED light; and an LED control circuit which adjusts power received via the power factor correction circuit and provides the adjusted power to an LED;

a voltage measurement circuit which senses a voltage of the LED and transmits the sensed voltage to the central control circuit, wherein the voltage measurement circuit comprises:

a first sensing unit which senses a voltage at a positive pole of the LED;

a second sensing unit which senses a voltage at a negative pole of the LED; and a comparison unit which compares a result of the voltage sensing of the first sensing unit with a result of the voltage sensing of the second sensing unit, wherein the power factor correction circuit comprises a bypass element connected between an input stage and an output stage.

2. The power apparatus of claim 1, wherein the bypass element is a rectifier element.

3. The power apparatus of claim 1, wherein a bead is connected to a gate of a switching element included in the power factor correction circuit.

4. The power apparatus of claim 1, wherein a bead is connected to a drain of a switching element included in the power factor correction circuit.

5. The power apparatus of claim 1, wherein a bead is connected between a drain and source of a switching element included in the power factor correction circuit.

6. The power apparatus of claim 3, wherein the bead is an inductance element.

7. The power apparatus of claim 5, wherein the bead is a capacitance element.

8. A power apparatus for an LED light, comprising:

a filter which blocks noise of input AC power;

a rectifier which is connected to the filter and converts the AC power into DC power;

a power factor correction circuit which controls a power factor of power received from the rectifier;

a central control circuit which controls an operation of the power apparatus for an LED light;

an LED control circuit which adjusts power received via the power factor correction circuit and provides the adjusted power to an LED; and a current conversion circuit which senses an electric current of the LED and transmits the sensed current to the LED control circuit, a voltage measurement circuit which senses a voltage of the LED and transmits the sensed voltage to the central control circuit, wherein the voltage measurement circuit comprises:

a first sensing unit which senses a voltage at a positive pole of the LED:

a second sensing unit which senses a voltage at a negative pole of the LED; and a comparison unit which compares a result of the voltage sensing of the first sensing unit with a result of the voltage sensing of the second sensing unit, wherein the current conversion circuit comprises:

a signal input unit which receives a pulse width modulation signal from the central control circuit;

a switching element which operates in response to the pulse width modulation signal received from the signal input unit; and a current control unit which is connected to the switching element, processes an electric current received from the LED in response to an operation of the switching element, and transmits the processed current to the LED control circuit.

9. The power apparatus of claim 8, wherein:

a duty ratio of the pulse width modulation signal received through the signal input unit is adjusted by the central control circuit, the switching element controls ON/OFF in response to the pulse width modulation signal having the adjusted duty ratio, and the current control unit controls an electric current inputted to the LED control circuit in response to the ON/OFF of the switching element.

10. The power apparatus of claim 8, wherein the switching element is an FET element.

11. The power apparatus of claim 10, wherein the signal input unit is connected to a gate terminal of the FET element.

12. The power apparatus of claim 10, further comprising a resistor between the signal input unit and a ground terminal.

13. The power apparatus of claim 10, wherein the current control unit has a plurality of resistors connected to a node connected to a drain terminal of the FET element.

14. The power apparatus of claim 10, wherein a capacitance element is included between a drain terminal of the FET element and a ground terminal.

15. The power apparatus of claim 9, wherein a level of a voltage output by the current control unit is adjusted in response to control of the duty ratio.

16. The power apparatus of claim 15, wherein:

if the duty ratio is 0, a minimum current of the current control unit flows into the LED control circuit, and if the duty ratio is 1, a maximum current of the current control unit flows into the LED control circuit.

17. A power apparatus for an LED light, comprising:

a filter which blocks noise of input AC power;

a rectifier which is connected to the filter and converts the AC power into DC power;

a power factor correction circuit which controls a power factor of power received from the rectifier;

a central control circuit which controls an operation of the power apparatus for an LED light;

an LED control circuit which adjusts power received via the power factor correction circuit and provides the adjusted power to an LED; and a voltage measurement circuit which senses a voltage of the LED and transmits the sensed voltage to the central control circuit, wherein the voltage measurement circuit comprises:

a first sensing unit which senses a voltage at a positive pole of the LED;

a second sensing unit which senses a voltage at a negative pole of the LED; and a comparison unit which compares a result of the voltage sensing of the first sensing unit with a result of the voltage sensing of the second sensing unit.

18. The power apparatus of claim 17, wherein the first sensing unit or the second sensing unit comprises a rectifying unit for filtering a positive voltage.

19. The power apparatus of claim 17, wherein the first sensing unit or the second sensing unit comprises a voltage adjustment unit for adjusting an amount of the sensed voltage.

20. The power apparatus of claim 19, wherein the voltage adjustment unit has a plurality of resistors connected in series.

21. The power apparatus of claim 17, wherein the first sensing unit or the second sensing unit comprises a smoothing unit for smoothing the sensed voltage.

22. The power apparatus of claim 21, wherein the smoothing unit is implemented by a capacitance element.

23. The power apparatus of claim 17, wherein the comparison unit is a differential amplification circuit.

* * * * *